United States Patent [19]

Andrianov et al.

[11] 4,042,534

[45] Aug. 16, 1977

[54] CONDUCTING ANISOTROPIC POLYMER MATERIAL

[76] Inventors: Kuzma Andrianovich Andrianov, Vystavochny pereulok, 3, kv. 9, Moscow; Mikhail Izmailovich Topchiashvili, ulitsa Tashkentskaya, 27/12, pod'ezd, 3, Tbilisi; Lotary Mikhailovich Khananashvili, ulitsa Sumskaya, 6, korpus 2, kv. 244, Moscow; Dali Georgievna Pagava, ulitsa Tskhvedadze, 30; Nikolai Alexandrovich Shermazanashvili, ulitsa Cheljuskintsev, 11, both of Tbilisi, all of U.S.S.R.

[21] Appl. No.: 447,051

[22] Filed: Feb. 28, 1974

[51] Int. Cl.[2] ..... H01B 1/06

[52] U.S. Cl. ..... 252/511; 252/512; 252/510

[58] Field of Search ..... 252/511, 512, 510, 518; 260/42.22, 42.46, 42.26, 42.15

[56] References Cited

U.S. PATENT DOCUMENTS

| | | | |
|---|---|---|---|
| 2,379,976 | 6/1943 | Maddock | 252/511 |
| 3,104,985 | 9/1963 | Williams et al. | 252/511 |
| 3,111,495 | 11/1963 | Murphy et al. | 252/511 |
| 3,760,495 | 9/1973 | Meyer | 252/511 |
| 3,862,056 | 1/1975 | Hartman | 252/511 |

*Primary Examiner*—Richard E. Schafer
*Assistant Examiner*—Josephine Lloyd

[57] ABSTRACT

Anisotropic polymer material which conducts electricity consists of a filler which conducts electricity and a polymer binder. Perchlorovinyl resin or a mixture of perchlorovinyl resin with phenylaminomethyl-methyldiethoxysilane can be used as the binder.

2 Claims, No Drawings

CONDUCTING ANISOTROPIC POLYMER MATERIAL

This invention relates to polymers conducting electricity and more particularly to an anisotropic conducting polymer material.

Said polymer is used to control static electricity in industry. This material can be used for the manufacture of low-temperature heating elements for de-icing purposes.

Anisotropic properties of the material can be utilized for radio-absorbing purposes too.

Known in the prior art is an electro-conducting anisotropic polymer material consisting of a filler conducting electricity and a binding material, which is a polymer black Carbon clock which conducts electricity is used as the material conducting electricity and a mixture of polymethylmethacrylate with methylmethacrylate is used as the binding material.

The said material however is stiff.

The object of the invention is to provide an elastic anisotropic polymer material conducting electricity.

This and other objects of the invention are accomplished according to the invention by using as the binding polymer in perchlorovinyl resin or a mixture of perchlorovinyl resin with phenylaminomethyl-methyldiethoxysilane.

The recommended ratio of perchlorovinyl resin to the conductive filler is 100 : 40–100 (w/w).

It is also recommended to use said conducting anisotropic polymer consisting of perchlorovinyl resin, phenylaminomethyl-methyldiethoxysilane and the conductive filler, in which said components are contained in the following proportions (weight parts):

perchlorovinyl resin—100
phenylaminomethyl-methyldiethoxysilane—10–100
conductive filler—40–100.

Known in the prior art are methods in which perchlorovinyl resin is plasticized by dibutyl phthalate, but at elevated temperatures (and also with time) dibutyl phthalate is evaporated thus impairing the physico-mechanical properties of the material. The introduction of phenylaminomethyl-methyldiethoxysilane eliminates this disadvantage due to the chemical interaction of this compound with the perchlorovinyl resin. The presence in the material of phenylaminomethyl-methyldiethoxysilane gives it increased resistance to the action of various aggressive media.

In the manufacture of the material of the invention use is made of the effect of the dissolution of perchlorovinyl resin in dichloroethane as a result of which a polymeric material is obtained possessing an averaged molecular weight which in turn is responsible for the uniform electric conductivity in the anisotropic polymer.

Depending on variations in the ratio of the binding material, the anisotropic coefficient in the polymer may vary from 10 to 1000 and the specific electrical resistance from 1 to $10^7$ ohm $\times$ cm.

The material of the invention can be widely used in industry to remove static electricity.

The material has been tested by multiple heating-cooling tests. The tests have shown that the anisotropic polymer of the invention can be used for the manufacture of low-temperature heating elements having a capacity of 0.3 – 0.8 W/sq.cm, which meets the requirements for heating elements employed at low temperatures.

The optimum thickness of the heating element depends on the specific operating conditions and can vary from 0.5 to 10 mm.

The important factor for practical use of the polymer of the invention is its adhesion to the protected (heated) surfaces.

The tests have shown that the material of the invention possesses high adhesion to metal, concrete, and that use of special glues and methods of glueing ensures its high workability with intricate profiles of the heated surfaces.

The anisotropic properties of the material make it applicable for absorption of radio waves.

The conducting anisotropic polymer of the invention is prepared as follows.

Perchlorovinyl resin is dissolved in dichloroethane in a mixer and then the material conducting electricity, for example carbon black, is added into the solution. Graphite, metals, salts of metals, can also be used for this purpose.

The components are mixed thoroughly and the obtained paste is transferred onto rollers where the mixture is treated at a temperature of 10°–50° C.

The rolled material is then kept at a temperature of 80° C for 2–8 hours (depending on the thickness of the samples).

If the anisotropic material having a binding material consisting of a mixture of perchlorovinyl resin with phenylaminomethyl-methyldiethoxysilane is prepared, phenylaminomethyl-methyldiethoxysilane is added in the liquid state to the dissolved perchlorovinyl resin, and then the conductive carbon black is added. The components are mixed thoroughly and rolled at a temperature of 10°–40° C. The material is then kept at a temperature of 100° C for 2–4 hours depending on the thickness of the samples.

For a better understanding of the invention it will be illustrated by the following examples of its practical embodiment.

EXAMPLE 1

100 parts by weight of perchlorovinyl resin are dissolved in 40 parts by weight of dichloroethane and 40 parts by weight of phenylaminomethyl-methyldiethoxysilane are added. Next lamp black (40 parts by weight) is introduced and the components are mixed to prepare a paste-like mass. The mass is then rolled at a temperature of 20°$\pm$5° C.

The rolled material is then kept at an elevated temperature. The prepared material has a specific electric resistance from $10^4$ to $10^5$ ohm $\times$ cm; the anisotropic coefficient is 100–500.

EXAMPLE 2

100 parts by weight of perchlorovinyl resin are dissolved in 40 parts by weight of dichloroethane and then 80 parts by weight of phenylaminomethyl methyldiethoxysilane are added. Finally 80 parts by weight of lamp black are introduced and the components are mixed into a paste-like mass, which is rolled at a temperature of 20°$\pm$5° C.

The material is finally kept at elevated temperatures.

The resultant material has a specific electric resistance of 1–$10^2$ ohm $\times$ cm and an anisotropic coefficient of 10–25.

EXAMPLE 3

100 parts by weight of perchlorovinyl resin are dissolved in 60 parts by weight of dichloroethane. Into the solution are added 40 parts by weight of lamp black and the components are mixed into a paste-like mass which is then rolled at a temperature of 40±10° C, and kept at elevated temperatures. The obtained material has a specific electric resistance of $10^4$–$10^5$ ohm × cm, and the anisotropic coefficient of 10–25.

EXAMPLE 4

100 parts by weight of perchlorovinyl resin are dissolved in 80 parts by weight of dichloroethane, and then 80 parts by weight of lamp black are added. The components are mixed into a paste-like mass, rolled at a temperature of 40±10° C and finally retained at elevated temperatures. The obtained material has a specific electrical resistance of 0.5–$10^2$ ohm × cm and an anisotropic coefficient of 10–100.

We claim:

1. A method of producing a conductive anisotropic polymer material comprising 20–50 weight parts of conductive black and 100 weight parts of the reaction product of perchlorovinyl resin and phenylaminomethyl-methyldiethoxysilane, comprising the steps of dissolving 100 weight parts of perchlorovinyl resin in 40–80 weight parts of dichloroethane; adding successively 10–100 weight parts of phenylaminomethyl-methyldiethoxysilane and 40–100 weight parts of conductive black to the resulting solution; stirring the mixture thus obtained, and rolling it at a temperature of 15° to 50° C.

2. A conductive anisotropic polymer material comprising 20–50 weight parts of conductive black and 100 weight parts of a mixture of perchlorovinyl resin and phenylaminomethyl-methyldiethoxysilane and prepared by the method of claim 1.

* * * * *